US010624452B2

(12) United States Patent
Perry

(10) Patent No.: US 10,624,452 B2
(45) Date of Patent: Apr. 21, 2020

(54) RACKING SYSTEM

(71) Applicant: Kenneth Perry, Dorchester, MA (US)

(72) Inventor: Kenneth Perry, Dorchester, MA (US)

( * ) Notice: Subject to any disclaimer, the term of this patent is extended or adjusted under 35 U.S.C. 154(b) by 0 days.

(21) Appl. No.: 16/112,652

(22) Filed: Aug. 25, 2018

(65) Prior Publication Data

US 2018/0360209 A1 Dec. 20, 2018

Related U.S. Application Data

(63) Continuation-in-part of application No. 15/462,016, filed on Mar. 17, 2017, now abandoned.

(60) Provisional application No. 62/436,550, filed on Dec. 20, 2016.

(51) Int. Cl.

| | |
|---|---|
| ***A47B 31/00*** | (2006.01) |
| ***A47B 47/00*** | (2006.01) |
| ***A47B 57/10*** | (2006.01) |
| ***A47B 96/02*** | (2006.01) |

(52) U.S. Cl.

CPC ..... *A47B 31/00* (2013.01); *A47B 47/0075* (2013.01); *A47B 57/10* (2013.01); *A47B 96/027* (2013.01); *A47B 96/028* (2013.01); *A47B 2031/002* (2013.01); *A47B 2031/003* (2013.01)

(58) Field of Classification Search

CPC ..... A47B 31/00; A47B 7/045; A47B 47/00; A47B 47/0075; A47B 71/00; A47B 43/00; A47B 2031/002; A47B 2031/003; A47F 5/116; A47G 19/08

USPC ... 108/162, 164, 176, 179, 106–108, 147.11, 108/147.17; 211/149, 150, 132, 72, 201, 211/186; 312/258, 262

See application file for complete search history.

(56) References Cited

U.S. PATENT DOCUMENTS

| | | | | | |
|---|---|---|---|---|---|
| 324,602 | A | * | 8/1885 | Solliday | |
| 2,615,583 | A | * | 10/1952 | Johnson | A47F 5/04 108/152 |
| 2,912,119 | A | * | 11/1959 | Robinson | A47B 96/028 108/135 |
| 3,550,891 | A | * | 12/1970 | Scott | A47B 57/045 108/108 |
| 4,716,841 | A | * | 1/1988 | Suttles | A47F 5/103 108/108 |
| 4,815,394 | A | * | 3/1989 | Edinger | A47B 57/265 108/107 |
| 5,299,509 | A | * | 4/1994 | Ballard | A47B 96/02 100/106 |
| 5,529,192 | A | * | 6/1996 | Conen | A47B 96/028 211/187 |
| 5,718,343 | A | * | 2/1998 | Belokin | A47B 47/00 211/118 |

(Continued)

FOREIGN PATENT DOCUMENTS

| | | | |
|---|---|---|---|
| CA | 2305658 | * | 4/1999 |
| DE | 102015102981 | * | 9/2016 |

(Continued)

*Primary Examiner* — Janet M Wilkens

(74) *Attorney, Agent, or Firm* — Bay State IP, LLC

(57) ABSTRACT

A catering shelving system is disclosed with a series of shelves in order to assist caters in transporting food from one location to another. The shelving system racks may be detachable or pivotally attached through the use of rotation mechanisms for easy break down and storage. The shelving system may accommodate a series of different types of pans of all shapes, sizes, and weights.

1 Claim, 3 Drawing Sheets

(56) References Cited

U.S. PATENT DOCUMENTS

| | | | | | |
|---|---|---|---|---|---|
| 6,070,536 | A * | 6/2000 | Cinkaj | A47B 96/027 | 108/152 |
| 6,446,817 | B1 * | 9/2002 | Stitt | G11B 15/682 | 211/134 |
| 6,814,418 | B2 * | 11/2004 | D'Orso | A47B 61/04 | 108/149 |
| 6,971,529 | B1 * | 12/2005 | Shapiro | A47B 47/00 | 211/188 |
| 7,845,604 | B2 * | 12/2010 | Connor, Jr. | A47F 5/08 | 211/85.23 |
| 2002/0043187 | A1 * | 4/2002 | Felton | A47B 46/005 | 108/107 |
| 2008/0083682 | A1 * | 4/2008 | Moss | A47F 5/116 | 211/72 |
| 2008/0283482 | A1 * | 11/2008 | Torke | A47F 7/0028 | 211/153 |

FOREIGN PATENT DOCUMENTS

| | | | |
|---|---|---|---|
| FR | 2859889 | * | 3/2005 |
| WO | 2015031960 | * | 3/2015 |

* cited by examiner

RACKING SYSTEM

CROSS REFERENCE TO RELATED APPLICATION

This application is a continuation-in-part application and claims the benefit of and takes priority from U.S. Utility application Ser. No. 15/462,016 filed on Mar. 17, 2017, which in turn claims the benefit of and takes priority from U.S. Provisional Application Ser. No. 62/436,550 filed on Dec. 20, 2016, the contents of which are herein incorporated by reference.

FIELD OF THE INVENTION

The present invention relates generally to shelving systems, specifically shelving systems for catering and food storage.

BACKGROUND OF THE INVENTION

Shelving systems have long been used for a variety of storage needs. More specifically, shelving in the catering business has been used to organize food trays, maximize space, prevent contamination, and store multiple meals at once. Shelving has also been used to transport food from the kitchen to the event location. Many caterers pack multiple trays into an insulated bag during transportation. This method presents a number of obstacles. Food is often crushed by the weight of multiple trays resting on top of each other, food is subject to spoilage, and bags can become messy quickly. These issues prevent caterers from delivering efficiently, causing the cost of catering to increase. Caterers also depend heavily on the quality of their food quality and presentation, thus crushed or spoiled food causes costly reputational losses.

Present shelving options do not fit the needs of caterers. They are, cumbersome, not sturdy, and difficult to transport. Moreover, existing shelves do not allow for top loader food delivery bags to accommodate a variety of pan sizes. This causes difficulties for caterers attempting to transport large pans from one location to the next. Because of the limited shelving available, many catering companies are unable to transport the quantity of food necessary to accommodate large events. Consequently, multiple trips and other, costlier means of transportation, drive up the price of catering. Additionally, food that does not fit into delivery bag shelving is more likely to spoil, causing monetary and reputational losses. This is particularly troublesome for caterers who depend on the quality of food and presentation to develop business through customer recommendations. In addition, caterers must utilize space as efficiently as possible to remain profitable.

There are several existing shelving systems, which can be adjustably fixed at a variety of predetermined heights. However, many such systems are either too bulky and difficult to use, or not sturdy enough to support a substantial amount of food.

SUMMARY OF THE INVENTION

The instant system, as illustrated herein, is clearly not anticipated, rendered obvious, or present in any of the prior art mechanisms, either alone or in any combination thereof. Thus, the several embodiments of the instant system are illustrated herein.

A primary object of the shelving system is to provide a sturdy, and versatile mode of transporting food, which increases efficiency while decreasing monetary and reputational loss resulting from damage and spoliation during transportation.

Another object of the shelving system is to provide a convenient shelving system that fits into a standard top loader food delivery bag, which is easy to assemble, disassemble, and clean.

In one embodiment, the present apparatus introduces a novel racking and shelving system to assist food caterers.

In another embodiment, the present apparatus introduces a novel racking system to accommodate a series of food pans of different weights, sizes, and shapes.

In yet another embodiment, the present apparatus introduces a novel racking system that prevents catering pans from being bent, smashed, and/or damaged during transportation of food from one location to another.

Another embodiment of the present apparatus introduces a novel racking system that ensures the usage of a top loading shelf to accommodate a series of food pans of different weights, sizes, and shapes.

In yet another embodiment, the present apparatus introduces a novel racking system that protects the transportation of catering food and ensures the food stays in place, preventing spills and damage to the food.

In yet another embodiment, the present apparatus introduces a novel racking system that allows for the racking of numerous pans in order to prevent any unnecessary stacking or pressure from multiply stacked pans.

In a further embodiment, the present apparatus introduces a novel shelving system that is an inexpensive alternative for caterers to transport food from one location to another.

In yet another embodiment, the present apparatus introduces a novel shelving system that is easy to manage and provides an efficient means to transport catered food from one location to another.

Realizing one embodiment of the system is a new shelving and racking system that provides a more efficient, inexpensive, safer, and cost effective system for caterers to shelve multiple food pans at once, transport the pans, and prevent any damage done on the pans and catered food during transportation.

These together with other objects of the system, along with the various features of novelty, which characterize the system and accompanying apparatuses, are pointed out with particularity in the claims annexed to and forming a part of this disclosure. For a better understanding of the system, its operating advantages and the specific objects attained by its uses, reference should be made to the accompanying drawings and descriptive matter in which there are illustrated preferred embodiments of the system.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

BRIEF DESCRIPTION OF THE DRAWINGS

The invention may be more completely understood in consideration of the following detailed description of the various embodiments of the invention in connection with the accompanying drawings, in which.

DETAILED DESCRIPTION OF THE SEVERAL EMBODIMENTS

Figure 2:
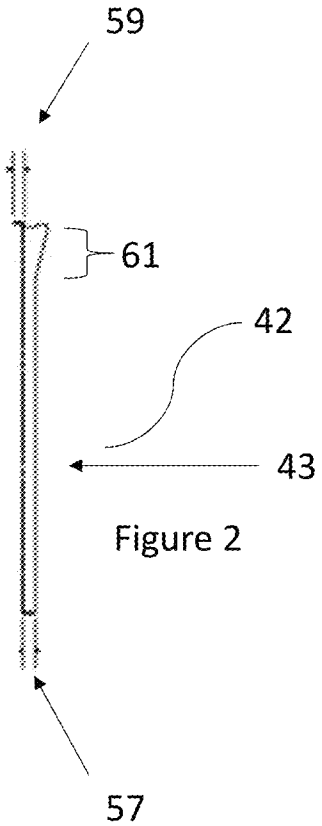
FIG. 2 illustrates a side view of one embodiment of a shelf of the shelving system.

The detailed description set forth below in connection with the appended drawings is intended as a description of presently-preferred embodiments of the apparatus and does not represent the only forms in which the present apparatus may be constructed and/or utilized. The description sets forth the functions and the sequence of steps for constructing and operating the apparatus in connection with the illustrated embodiments. However, it is to be understood that the same or equivalent functions and sequences may be accomplished by different embodiments that are also intended to be encompassed within the spirit and scope of the invention.

For the following defined terms, these definitions shall be applied, unless a different definition is given in the claims or elsewhere in this specification. All numeric values are herein assumed to be modified by the term "about", whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following description should be read with reference to the drawings wherein like reference numerals indicate like elements throughout the several views. The drawings, which are not necessarily to scale, depict illustrative embodiments of the claimed invention.

Figure 1:
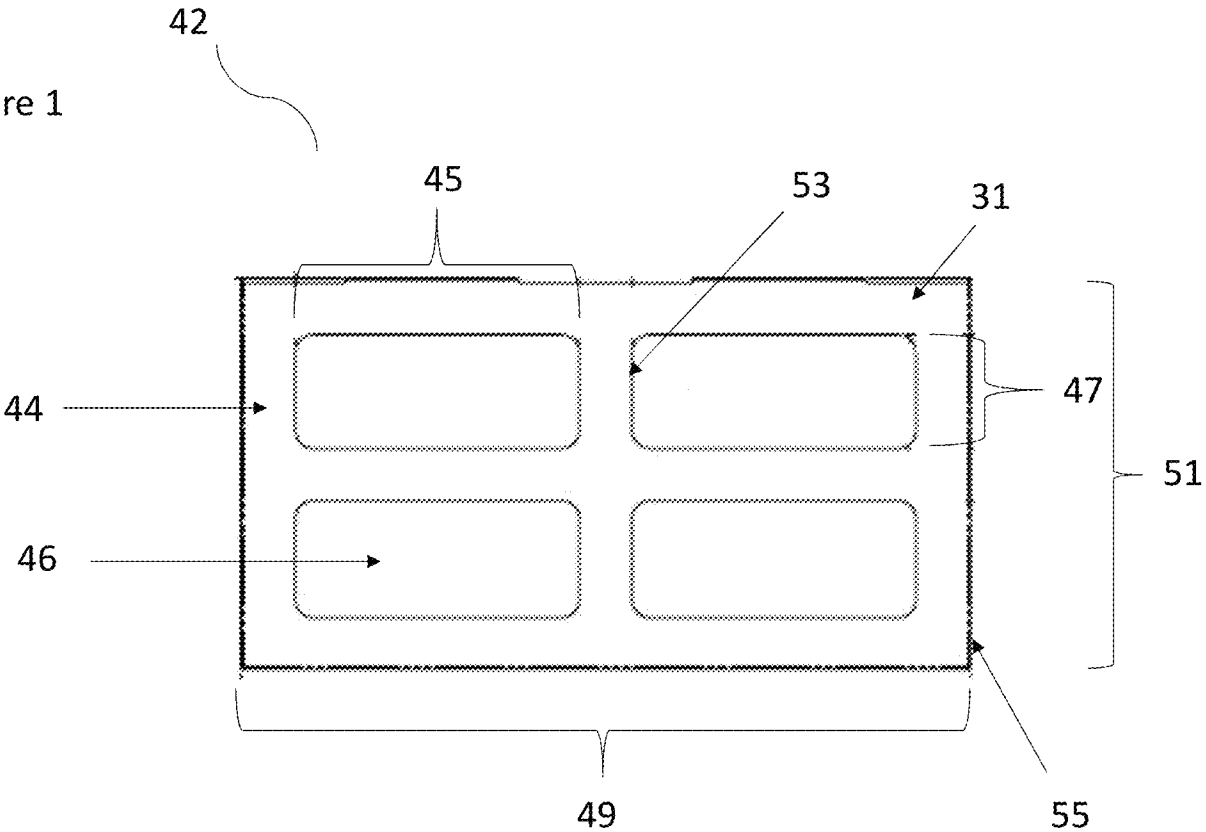
FIG. 1 illustrates a top view of one embodiment of a shelf of the shelving system.

FIG. 1 illustrates a top 31 view of one embodiment of a shelf 42, wherein the shelf 42 comprises a shelf body 44 and a plurality of rectangular cavities 46. The rectangular cavities 46 further comprise an even number of symmetrically disposed recesses, which decrease the weight of each shelf 42 while retaining its structural integrity. In another embodiment, the positioning of the long side 45 and the short side 47 of the rectangular cavities 46, correspond in ratio to a length edge 49 and a width edge 51 of the shelf 42. However, in other applications, it may be advantageous to fabricate the shelf 42 such that the long side 45 and short side 47 of the rectangular cavities 46 comprise an inverse ratio to the length edge 49 and the width edge 51 of the shelf 42 (this embodiment is not pictured).

The rectangular cavities 46 improve the amount of friction exerted between the shelf 42 and a variety of tray types, which are placed on top of the shelf 42. The inside edges 53 of the rectangular cavities 46 are beveled, forming a smooth rounded edge, which improves the safety of the shelves 42 and prevents the shelves from damaging any food delivery bag into which the shelving is placed. The outer edge 55 of the shelves 42 are similarly beveled, which improves the safety and prevents the user from being cut or sliced when handling the shelves 42. The shelf body 44 is composed of a hard, non-flexible material such as stainless steel, aluminum, a composite material, or any other dent-resistant, durable material capable of supporting a significant load.

In yet another embodiment, no plurality of rectangular cavities 46 exist on the shelf body 44, which comprises a solid surface. This embodiment may be useful for particularly heavy trays or for increased heat retention during long trips.

Figure 10:
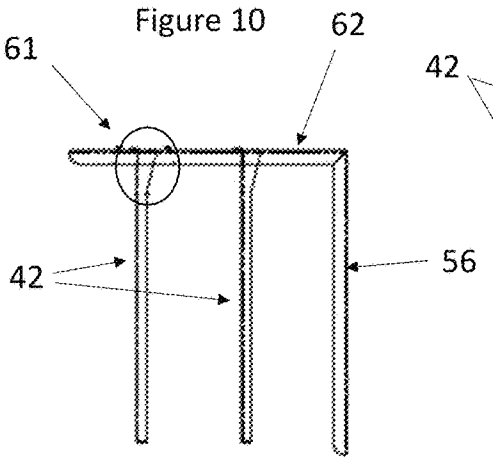
FIG. 10 illustrates a side view of one embodiment of the assembled shelving system.

FIG. 2 illustrates a side view of the width edge 51 of one embodiment of the shelf 42. The back end 59 of the shelf 42 comprises the side that is attached to the back panel 62 of the support means 63 (as shown in FIG. 10). The front end 57 of the shelf 42 comprises the side opposite to the back end 59. The back end 59 further comprises a taper 61 on the bottom side 43 of the shelf 42, which tapers 61 outward from the direction of the front end 57 to the back end 59. The taper 61 facilitates attachment of the shelf 42 to the back panel 62 and improves the load bearing properties of the shelf 42 by providing extra support at the point on the shelf 42 where pressure is greatest.

Figure 3:
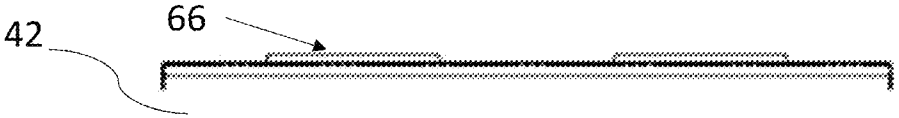
FIG. 3 illustrates a front view of one embodiment of a shelf of the shelving system.

FIG. 3 illustrates a front view of one embodiment of a shelf 42, which is removably fixed to the back panel 62. The shelf 42 is attached to two receiving notches 66, which are flush with the surface of the back panel 62 (note that the back panel is not pictured here).

Figure 4:
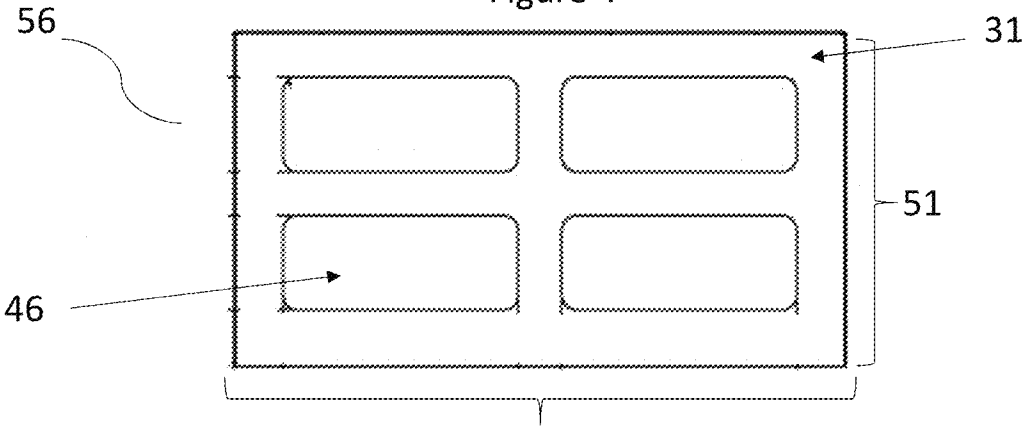
FIG. 4 illustrates a top view of a bottom shelf of the shelving system.

FIG. 4 illustrates a top view of a bottom shelf 56. The bottom shelf 56 is substantially similar to the shelves 42, however it is permanently fused in a perpendicular orientation with the back panel 62 (shown in FIG. 6). Moreover, the bottom shelf 56 does not comprise the same attachment means 69 as the other shelves 42, rather, its length edges 49 and width edges 51 comprise uninterrupted beveled edges.

Figure 5:
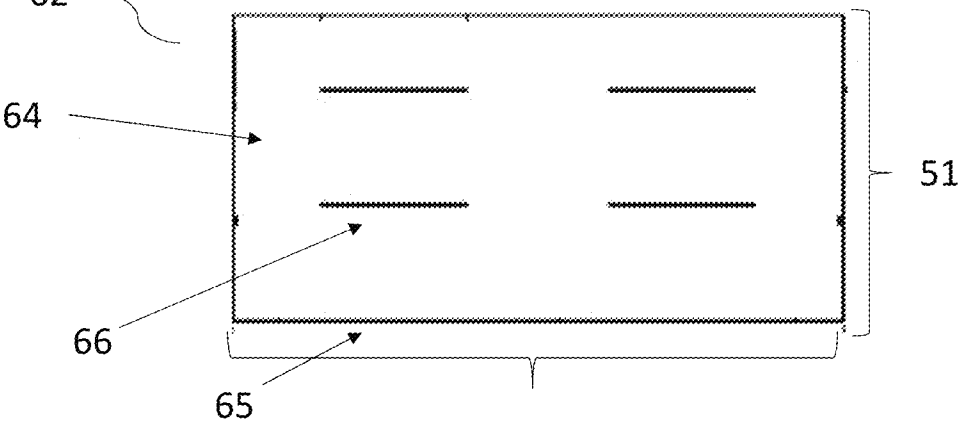
FIG. 5 illustrates a front view of one embodiment of the back panel of the shelving system.

FIG. 5 illustrates a front view of one embodiment of the back panel 62 of the support means 63. The back panel 62 comprises a panel body 64 and a plurality of receiving notches 66. Each of the receiving notches 66 further comprises a narrow slit in the back panel 62, which receives an attachment means 69 from a shelf 42. The receiving notches 66 can therefore removably support a shelf 42.

Figure 6:
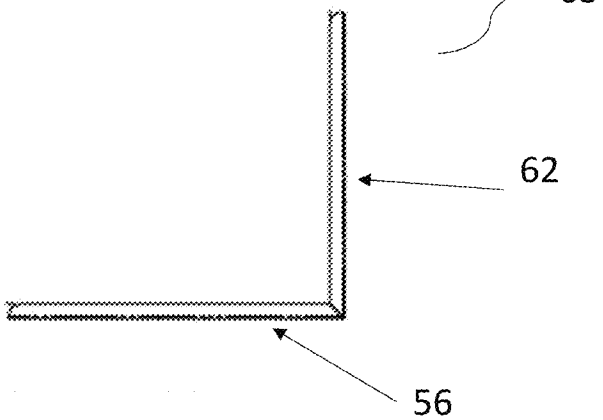
FIG. 6 illustrates a side view of the assembled shelving system frame.

FIG. 6 illustrates a side view of the assembled support means 63, further comprising the bottom shelf 56 permanently fused to the back panel 62 in a perpendicular orientation.

Figure 7:
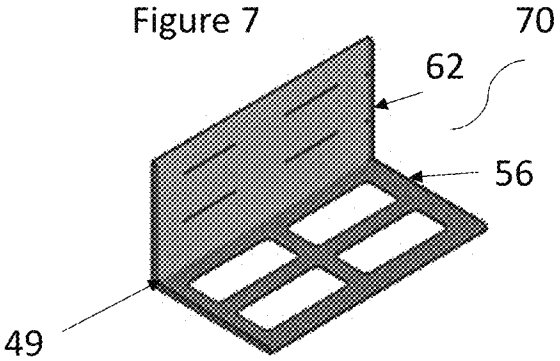
FIG. 7 illustrates a perspective view of the assembled shelving system frame.

FIG. 7 illustrates a perspective view of the assembled support means 63, wherein the bottom shelf 56 is permanently fused along is length edge 49 to the length edge 49 of the back panel 62.

Figure 8:
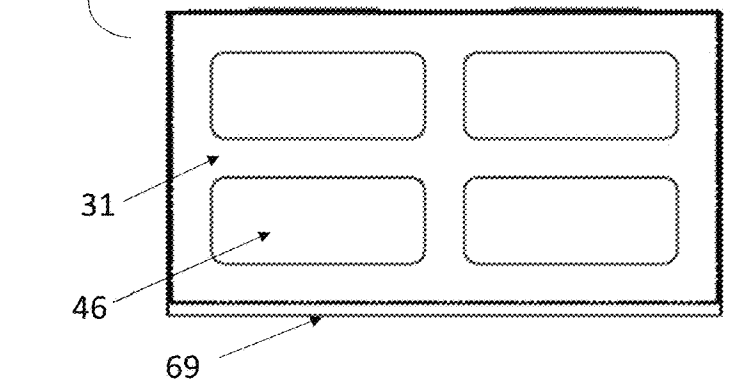
FIG. 8 illustrates a top view of a further embodiment of a shelf of the shelving system.

FIG. 8 illustrates a top 31 view of a further embodiment of shelf 42 with a single attachment means 69.

Figure 9:
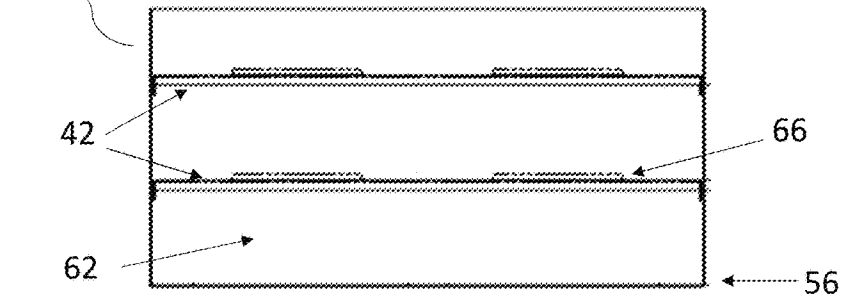
FIG. 9 illustrates a front view of a further embodiment of the back panel of the shelving system.

FIG. 9 illustrates a front view of one embodiment of the assembled shelving system 72. The assembled shelving system 72 comprises a plurality of shelves 42, a bottom shelf 56, and a back panel 62. Each shelf 42 is evenly spaced, parallelly aligned, and removably fixed to the receiving notch 66.

FIG. 10 illustrates a side view of one embodiment of the assembled shelving system 72. The assembled shelving system 72 comprises a plurality of shelves 42, a bottom shelf 56, and a back panel 62. The back panel 62 may be fabricated to support numerous additional shelves 42. Each shelf's 42 back end 59 attaches to a receiving notch 66 of the back panel 62.

Figure 11:
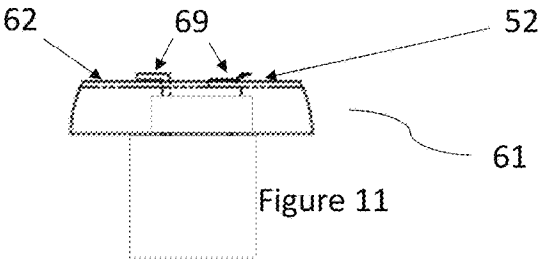
FIG. 11 illustrates a top view of the shelf attachment portion of the shelving system.

FIG. 11 illustrates an exploded view of the tapered 61 portion of the shelf 42, which comprises an attachment means 69, which removably affixes the shelf 42 to the receiving notch 66 of the back panel 62. The attachment means 69 further comprises a plurality of evenly spaced hook shaped latches (or a single latch), each spanning the length of the receiving notch 66 (shown in FIG. 9). The attachment means 69 further comprises a hard hook composed of a hard, non-flexible material such as stainless steel, aluminum, a composite material, or any other dent-resistant, durable material capable of supporting a significant load. The attachment means 69 curves upward toward the top 31 side of the shelf 42, such that when the support means 63 is fully assembled and a load is placed on the top 31 side of the shelf 42, a force is exerted from the attachment means 69 to the back panel 62, which holds the panel in place. The curved shape of the attachment means 69 also facilitates easy assembly and disassembly of the shelving system 72.

Figure 12:
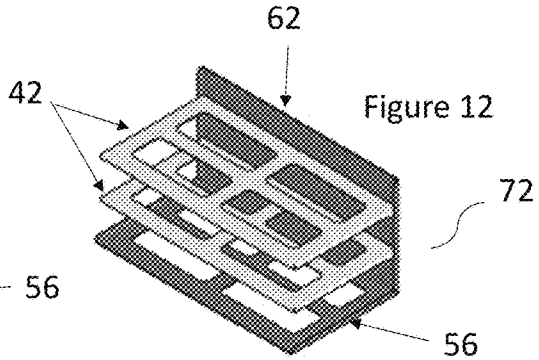
FIG. 12 illustrates a perspective view of one embodiment of the assembled shelving system.

FIG. 12 illustrates a perspective view of one embodiment of the assembled shelving system 72, which fits into a delivery bag. The assembled shelving system 72 comprises the bottom shelf 56, back panel 62 and a plurality of shelves 42. In a preferred embodiment, the shelving system 72 displays three shelves 42 but in other embodiments, the shelving system 72 may display more or fewer shelves 42. The sizes and dimensions of the shelves 42 may also vary in different embodiments.

It should be understood that various alternatives to the embodiments of the disclosure described herein may be employed in practicing the disclosure. Elements of an implementation of the systems and methods described herein may be independently implemented or combined with other implementations. It is intended that the claims to follow with the utility application define the scope of the disclosure and that systems, methods, and devices within the scope of these claims and their equivalents be covered thereby.

What is claimed is:

1. A shelving system comprising:

a plurality of shelves, wherein each shelf comprises:

a shelf body;

an attachment means; and a plurality of symmetrically disposed rectangular cavities, wherein each rectangular cavity comprises an even number of symmetrically disposed recesses;

wherein each rectangular cavity comprises a long side and a short which correspond in ratio to a length edge and a width edge of the shelf;

a back panel, said back panel comprising:

a plurality of receiving notches into which the attachment means is inserted, wherein a length of the receiving notches extends horizontally;

a bottom shelf comprising a length edge permanently affixed to a length edge of the back panel in a perpendicular orientation;

wherein each rectangular cavity comprises an inside edge that is beveled and each shelf comprises an outside edge that is beveled;

wherein each shelf comprises a back end that is attached to the back panel, and the back end comprises a taper on a bottom side of the shelf which tapers outward from the direction of a front end to the back end;

wherein each shelf is removably fixed to the back panel by two receiving notches which are flush with a surface of the back panel;

wherein the bottom shelf is permanently fused in a perpendicular orientation with the back panel;

wherein the back panel comprises a panel body and the plurality of receiving notches, each receiving notch comprises a narrow slit in the back panel to receive the attachment means from each shelf; and wherein the attachment means is on the tapered portion of the back end of each shelf and is curved upward toward a top side of the shelf;

when attached to the back panel, a force from the attachment means is exerted to the back panel to hold the shelf in place when a load is placed on the top side of each shelf.

* * * * *